US007637716B2

(12) United States Patent
Benton

(10) Patent No.: US 7,637,716 B2
(45) Date of Patent: Dec. 29, 2009

(54) PLATFORM COOLING ARRANGEMENT FOR THE NOZZLE GUIDE VANE STATOR OF A GAS TURBINE

(75) Inventor: Robert Benton, Berlin (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 328 days.

(21) Appl. No.: 11/152,791

(22) Filed: Jun. 15, 2005

(65) Prior Publication Data

US 2006/0078417 A1 Apr. 13, 2006

(30) Foreign Application Priority Data

Jun. 15, 2004 (DE) ..... 10 2004 029 696

(51) Int. Cl.
*F03B 11/00* (2006.01)

(52) U.S. Cl. ..... 415/116; 415/115; 416/97 R; 416/96 R

(58) Field of Classification Search ..... 415/115, 415/116; 416/97 R, 97 A, 95, 96 R, 96 A
See application file for complete search history.

(56) References Cited

U.S. PATENT DOCUMENTS

| | | | | |
|---|---|---|---|---|
| 3,800,864 | A | 4/1974 | Hauser | |
| 4,573,865 | A | 3/1986 | Hsia | |
| 5,344,283 | A * | 9/1994 | Magowan et al. | 415/115 |
| 5,382,135 | A * | 1/1995 | Green | 416/97 R |
| 6,082,961 | A | 7/2000 | Anderson | |
| 6,210,111 | B1 * | 4/2001 | Liang | 416/97 R |
| 6,341,939 | B1 * | 1/2002 | Lee | 416/97 R |
| 6,468,032 | B2 | 10/2002 | Patel | |
| 6,568,187 | B1 | 5/2003 | Jorgensen | |
| 6,612,114 | B1 | 9/2003 | Klingels | |
| 6,616,405 | B2 * | 9/2003 | Torii et al. | 416/97 R |
| 6,672,074 | B2 | 1/2004 | Tiemann | |

(Continued)

FOREIGN PATENT DOCUMENTS

DE 32 31 689 A1 3/1983

(Continued)

OTHER PUBLICATIONS

Stefan Friedrichs, Endwall Film-Cooling in Axial Flow Turbines, A Dissertation Submitted for the Degree of Doctor of Philosophy, Whittle Laboratory, Cambridge University (Jan. 1997).

*Primary Examiner*—Igor Kershteyn
(74) *Attorney, Agent, or Firm*—Timothy J. Klima; Shuttleworth & Ingersoll, PLC

(57) ABSTRACT

On a platform cooling arrangement for the nozzle guide vane stator of a gas turbine arranged downstream of the combustion chamber, one or several parallel row(s) of cooling-air ejection ducts (10) are arranged continuously or in groups on the circumference. The cooling-air ejection ducts are angled relative to the axial direction at an angle ($\alpha$) to produce a vortex structure on the surface of the platform (2) which, on the one hand, reduces mixing of the cooling air jets (11) with the hot gas flow (8) and, on the other hand, ensures complete cooling of the area of boundary layer separation (12) downstream of a boundary layer separation line (13) up to the suction side (14) of the adjacent nozzle guide vane (1).

27 Claims, 2 Drawing Sheets

U.S. PATENT DOCUMENTS

| | | | | |
|---|---|---|---|---|
| 6,887,033 | B1 * | 5/2005 | Phillips et al. | 415/115 |
| 6,945,749 | B2 * | 9/2005 | De Cardenas | 415/115 |

FOREIGN PATENT DOCUMENTS

| | | | |
|---|---|---|---|
| DE | 198 13 779 | A1 | 3/1998 |
| EP | 0 615 055 | A1 | 9/1994 |
| EP | 0902164 | A1 | 3/1999 |
| FR | 2198054 | | 3/1974 |
| FR | 2313551 | | 12/1976 |
| GB | 980363 | A | 1/1965 |
| GB | 1545904 | | 5/1979 |

* cited by examiner

PLATFORM COOLING ARRANGEMENT FOR THE NOZZLE GUIDE VANE STATOR OF A GAS TURBINE

This application claims priority to German Patent Application DE10 2004 029 696.0 filed Jun. 15, 2004, the entirety of which is incorporated by reference herein.

BACKGROUND OF THE INVENTION

This invention relates to a platform cooling arrangement for the nozzle guide vane stator of a gas turbine arranged downstream of the combustion chamber, with cooling-air ejection ducts passing through the wall of the combustion chamber, the wall of the platforms and/or the wall of a spacer located between the combustion chamber and the platforms, these cooling-air ejection ducts being arranged on the circumference of the respective wall, in at least one continuous or discontinuous row or in any pattern, to feed cooling air taken from the compressor of the gas turbine to the main gas flow surfaces of the platforms for film cooling.

The above type of cooling of the platforms of the nozzle guide vanes arranged downstream of the annular gas exit opening of the combustion chamber of a gas turbine and forming a stator assembly confined by the inner and outer platforms is known from Specification DE 198 13 779 A1, for example. Here, cooling air taken from the compressor is blown into the boundary layer of the hot-gas flow via cooling-air holes provided in the combustion chamber wall in the area of the exit opening or also directly in the platforms or a spacer between the combustion chamber and the platforms. By blowing in cooling air, the temperature of the hot-gas flow discharged from the combustion chamber is reduced in a flow layer contacting the inner surfaces of the platforms in order to shield the platform material from the remaining, uncooled hot-gas flow. If left unprotected, the platform material would be subject to so high a thermal load that the life of the platforms of the nozzle guide vanes would be significantly reduced. However, the cooling-air ejection holes, which usually are circumferentially distributed in the area of the annular exit opening of the combustion chamber or near the leading edge of the annularly arranged platforms, respectively, are not capable of effectively shielding or cooling the entire inner surface of the platforms against the hot-gas flow, this being due to the complicated flow conditions in the wall-near area, and also to the interaction between the hot-gas flow and the blown-in cooling air. This is attributable to a three-dimensional inlet boundary layer separation along a certain—variable—line on the Surface of the platforms. In order to obtain effective cooling over a maximum area of the platform surfaces, i.e. also in the area of the three-dimensional secondary flow, Specification DE 198 13 779 provides for a cooling-air ejection, termed ballistic cooling, in a direction corresponding to the radius, i.e. in a plane limited by the turbine axis and the radius, at a relatively steep ejection angle to the turbine axis with high impulse ratios, in which the cooling-air ejection holes forming at least one row are arranged in groups spaced from each other in turbine circumferential direction, each confined to an area from the leading edge to the pressure side of the respective nozzle guide vane. Accordingly, the intent of the so-called "ballistic cooling" in an area confined to the pressure side of the nozzle guide vanes is to bring the cooling medium to, and adequately cool also those platform surfaces, which are located in the area behind the three-dimensional inlet boundary layer separation line.

Specification EP 0 615 055 A1, whose technical teaching is also based on the above-mentioned principle of film cooling or ballistic cooling of the platforms, in contrast to the solution described in Specification DE 198 13 779 A1, provides for at least one circumferentially uninterrupted row of ejection ducts which, however, feature different diameters in the circumferential direction to obtain a certain mass flow distribution, enabling a maximum of full-surface cooling of the platform surface. Also with this cooling arrangement, the orientation of the ejection ducts, except for a certain incidence angle required for passing the platform or the combustion chamber wall, agrees with the plane established by the turbine axis and the radius.

However, the above cooling arrangements, due to a high degree of mixture with the hot-gas flow and an excessively large distance between the cooling air and the platform, are not capable of efficiently utilizing the blown-in cooling air and, moreover, ensuring an adequate degree of film cooling in all surface areas of the platforms, i.e. also in the downstream separation area of the boundary layer. In order to achieve an adequate degree of hot-gas shielding of the platforms, it will, therefore, be required to use a relatively high cooling-air proportion and/or provide a thermal barrier coating or enhance the effectivity of such a coating, with costs being increased correspondingly. In certain cases, a complex cooling system may be required for surfaces outside the hot-gas flow which would result in an increase of specific fuel consumption and costs, just as with the film cooling of the nozzle guide vane passage.

BRIEF SUMMARY OF THE INVENTION

The present invention, in a broad aspect, provides a platform cooling arrangement of the type specified above which ensures effective cooling of all main gas-low surfaces of the platform.

It is a particular object of the present invention to provide a solution to the above problems by a platform cooling arrangement designed in accordance with the features described herein. Further useful developments and advantageous embodiments of the present invention become apparent from this description.

The basic point of the present invention is the arrangement of at least part of the cooling-air ejection ducts in a direction given by an angle a from plane established by the turbine axis and the radius. In other words, the cooling-air ejection ducts are angled in relation to the circumferential direction. This angular position, which differs from the usual straight orientation of the cooling-air ejection ducts, and the corresponding direction of the cooling air flow to the platforms, surprisingly provides for reduced mixing with the hot-gas flow and for increased concentration of the cooling air in the end wall area, this results in an increase of cooling efficiency and a reduction of the cooling air requirement. The angulation of the cooling air jets produces a vortex structure in which less hot gas is taken up and which is capable of cooling the platform area behind the three-dimensional boundary layer separation effectively and in all areas between the pressure side and the suction side of the adjacent nozzle guide vanes. The reduced cooling air requirement and the improved cooling effectiveness enable the investment for additional cooling measures, if applicable, as well as fuel consumption to be reduced and the emission characteristics to be improved.

In accordance with the present invention, at least part of the cooling-air ejection ducts are angled in relation to the circumferential direction. This means that the magnitude of the angle at which the adjacent cooling-air ejection ducts are orientated may differ and in some cases even be 0°.

The circumferentially arranged cooling-air ejection ducts may be provided in one or several, discontinuous or continuous rows or also in regular or irregular groups or even individually and may have variable shape and size. The angling of the cooling-air ejection ducts can differ between adjacent rows or within one and the same row or group of cooling-air ejection ducts.

In addition, the cooling-air ejection ducts may be offset to each other in one and the same row or relative to the respective adjacent row.

The size and/or shape of the cross-section in one and the same row or relative to the adjacent rows or in any other arrangement of cooling-air ejection ducts may differ.

BRIEF DESCRIPTION OF THE DRAWINGS

The present invention is more fully described in the light of the accompanying drawings showing a preferred embodiment. In the drawings.

DETAILED DESCRIPTION OF THE INVENTION

Figure 1:
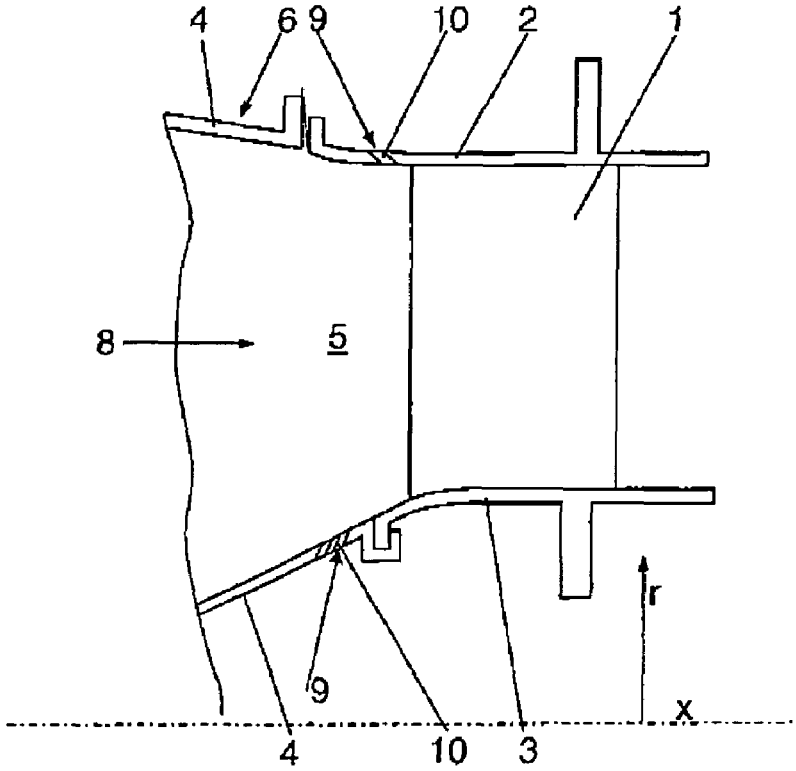
FIG. 1 is a partial view of the combustion chamber of a gas turbine with a nozzle guide vane system arranged immediately downstream of the gas exit opening.
Figure 2:
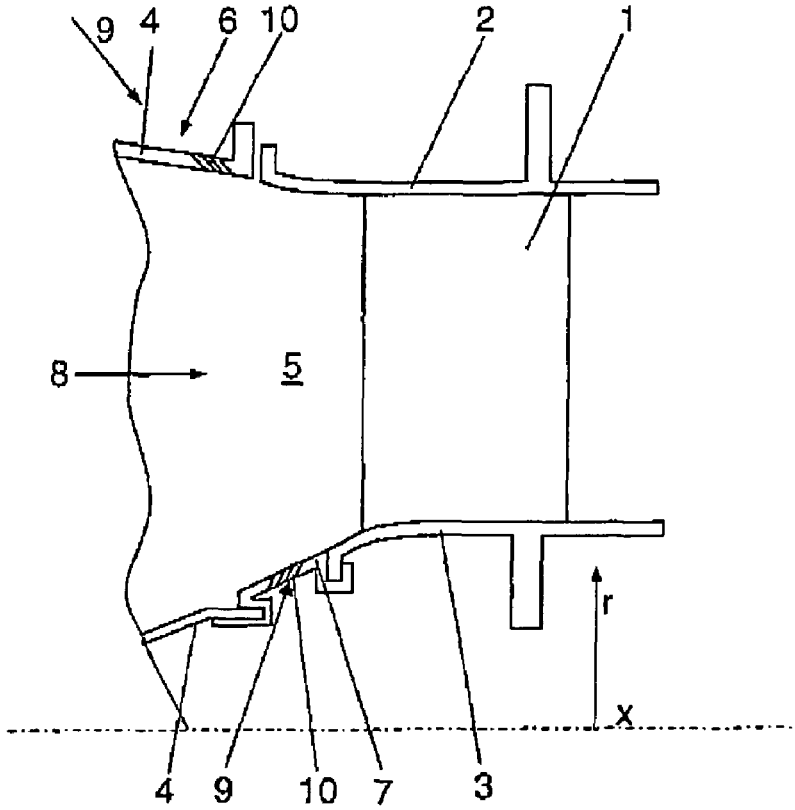
FIG. 2 is a partial view of the combustion chamber with a spacer arranged between the gas exit opening and the nozzle guide vane system.

FIGS. 1 and 2 each show a nozzle guide vane 1 arranged between an outer platform 2 and an inner platform 3. A plurality of nozzle guide vanes 1 with platforms 2, 3 form a stator assembly located downstream of the annular gas exit opening 5 of a combustion chamber 6. The outer platforms 2 and the inner platforms 3 are attached or connected to the wall 4 of the combustion chamber 6, or its gas exit opening 5, directly as shown in FIG. 1 and via a spacer 7 as shown in FIG. 2. A hot-gas flow (arrow 8) issuing from the gas exit opening 5 passes the adjacent nozzle guide vanes 1 and the platforms 2, 3. In order to reduce the thermal load of the vane and platform material caused by the high gas temperature, the nozzle guide vanes 1 and the platforms 2, 3 are cooled. Cooling of the platforms, which is the subject matter of the present application, is achieved with part of the cooling air (arrow 9) taken from the compressor (not shown) and not used in the combustion process. For this purpose, cooling-air ejection ducts 10 are provided in circumferential distribution in the outer platforms 2 and in the inner wall 4 of the combustion chamber 6 near the gas exit opening 5, as illustrated in FIG. 1. According to FIG. 2, the cooling-air ejection ducts 10 are provided in the outer wall 4 of the combustion chamber 6 and in a spacer 7 arranged between the inner platform 3 and the inner wall of the combustion chamber 6. As regards the respective arrangement of the cooling-air ejection ducts 10 in the platforms, the combustion chamber wall or the spacer, other combinations are also imaginable.

The cooling-air ejection ducts 10 are provided on the circumference of the inner or outer wall 4, the platforms 2, 3 or the spacer 7 in at least one—continuous or discontinuous—row (not shown) and—with several rows—can be arranged in-line or offset to each other. The cross-sectional area of the cooling-air ejection ducts 10 is round or oval, but may also have any other shape.

Figure 3:
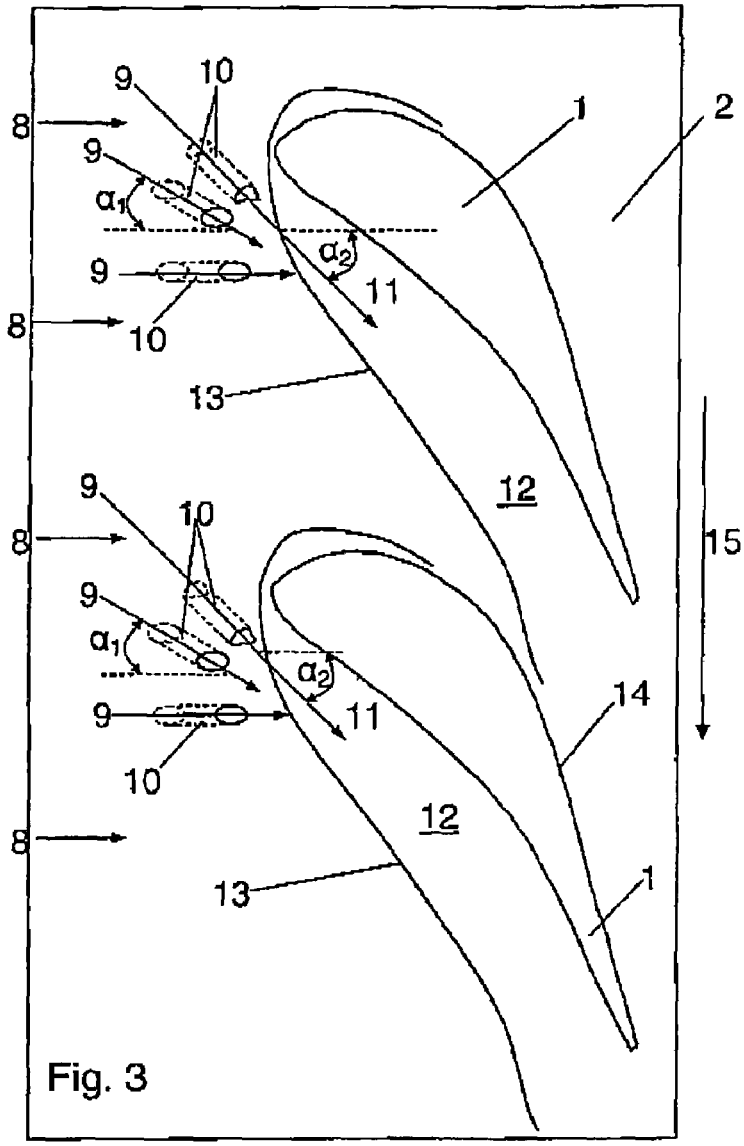
FIG. 3 is a sectional view of two adjacent nozzle guide vanes, both arranged on a platform, with a group of cooling-air ejection ducts allocated to each nozzle guide vane and extending in the platform in different angular positions.
Figure 4:
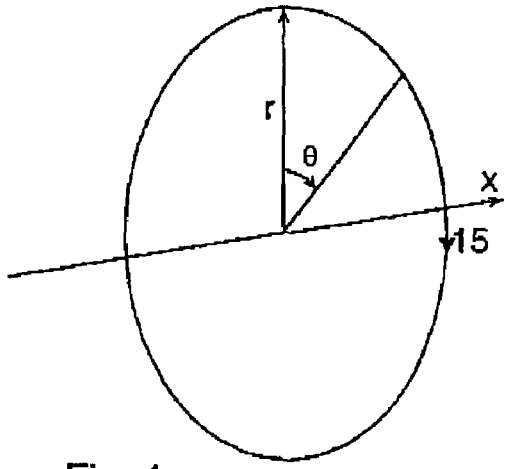
FIG. 4 is a geometrical representation of the angular position of the cooling-air ejection ducts relative to the circumferential direction.

The cooling air ejection ducts 10 have two components of angular orientation with respect to the turbine axis x. The first component of angular orientation is an inclination toward the annular gas exit opening 5 (inward toward the hot gas flow 8 from an exterior of the walls 4). The second component of angular orientation is an angling away from the axial direction, i.e., an angling across the hot gas flow 8. FIGS. 1 and 2 best show the first component of angular orientation of the cooling-air ejection ducts 10, an inclination inward toward the annular gas exit opening, as is usual in the state of the art. FIG. 3 best illustrates the second component of angular orientation, where, in each of the two shown groups of three cooling air ejection ducts 10, the upper two cooling air ejection ducts have a further orientation at a respective angle $\alpha$ ($\alpha_1$, $\alpha_2$) from the axial direction, in either direction away from the axial direction. The lower cooling air ejection duct 10 in each group is representative of the state of the art, with no angling away from the axial direction, only an inclination toward the annular gas exit opening 5, or in other words, having an angle $\alpha$ of 0° with respect to the axial direction. Ducts that have an angle $\alpha$ of 0° lie in a plane defined by r and x, which plane encompasses the axis x and the radial line r which intersects the outlet of the duct 10. The angle $\alpha$ is defined by FIG. 3, which shows a view of the platforms "unwrapped" with the view toward the hot gas-washed surfaces of the platforms and such that the parts of FIG. 3 are viewed along a radial line from the engine axis. It is important to note that the above description applies to the angle of the outlet of the duct, and while the ducts 10 shown in the Figs. are all shown as being straight, they could also be curved and/or have a compound configuration so that the inlet of the duct 10 is at a different angle than the outlet of the duct 10.

As a result of this second component of angling, the cooling-air jets (arrow 11) issuing from the cooling-air ejection ducts 10 extend on the surface of the platforms 2, 3 in a direction deviating from the axial direction by the angle $\alpha$, i.e., they are also angled in relation to the circumferential direction (arrow 15).

The angle $\alpha$ in a broad sense of the present invention is greater than 0° and up to and including 90°, as well as any range of angles therein. Initial modeling has indicated that in certain embodiments of gas turbines, an angle $\alpha$ falling within the range (inclusive) of 25°-90°, and more preferably, 45°-90°, in either direction away from the axial direction, may provide preferred results.

It has also been determined that a minimum cross-sectional area of the outlet of the ducts is preferable to provide the desired effect, because if the ducts are too small, they will not provide sufficient penetration for desired results. It is presently believed that this duct outlet area be controlled by the following equation:

$$\text{Cooling Duct Cross Sectional Area} \geq F \times (\text{NGV Leading Edge Annulus Area})/(\text{Number of NGVs})$$

where

NGV=Nozzle Guide Vane $$\text{NGV Leading Edge Annulus Area} = \pi \times ((\text{NGV Aerofoil Leading Edge Outer Radius})^2 - (\text{NGV Aerofoil Leading Edge Inner Radius})^2)$$

Using the above equation, the desired Cooling Duct Cross Sectional Area is obtained when F is greater than 0.0015. Therefore, F is preferably within any range greater than 0.0015, including the preferred range of 0.0015-0.010 inclusive, and all ranges therein. It is presently believed that preferred results will be obtained when F is greater than or equal to 0.002, and more preferably, greater than or equal to 0.003. It is also contemplated that preferred results will be obtained when F is also less than or equal to 0.006 and more preferably, less than or equal to 0.005. Not all of the angled ducts 10 need to comply with the above equation and ranges, but it is preferred that at least some do.

This cooling air flow direction 11 in combination with the hot gas flow 8 from the combustion chamber forms a vortex structure which, on the one hand, minimizes the mixing of the cooling air jets 11 with the hot gas flow 8 and, on the other hand, ensures coverage of the entire platform surface with cooling air, i.e. also in the area 12 downstream of the boundary layer separation line 13 and, in particular, also in the area adjacent to the suction side 14 of the nozzle guide vanes 1. This results in a reduction of the cooling air demand and, thus, an improvement of the emission values since a larger air quantity is available for combustion. If applicable, the thermal barrier coating of the platform surfaces can be dispensed with, leading to a reduction of the respective costs. If applicable, a complex cooling system for the surfaces subject to the hot-gas flow can be omitted or the cooling of the passage between the nozzle guide vanes can be avoided, thus enabling specific fuel consumption and costs to be lowered.

The angular position of the cooling-air ejection ducts 10 can be equal or different in each adjacent row of cooling-air ejection ducts. Furthermore, it is imaginable that the cooling-air ejection ducts 10 can be arranged in one and the same—continuous or discontinuous—row (or pattern) at different angles $\alpha$1, $\alpha$2, etc., relative to the platforms 1, 2, the spacer 7 or the wall 4 of the combustion chamber 6, as indicated in FIG. 3.

LIST OF REFERENCE NUMERALS

1 Nozzle guide vane
2 Outer platform
3 Inner platform
4 Inner/outer wall of 6
5 Gas exit opening
6 Combustion chamber
7 Spacer
8 Hot gas flow
9 Cooling air
10 Cooling-air ejection duct
11 Cooling-air jet
12 Area of boundary layer separation
13 Boundary layer separation line
14 Suction side of 1
15 Circumferential direction
x Turbine axis
r Radius
$\alpha_1$, $\alpha_2$ Ejection angle in circumferential direction (relative to plane r, x)

What is claimed is:

1. A platform cooling arrangement for a nozzle guide vane stator of a gas turbine arranged downstream of a combustion chamber, with cooling-air ejection ducts passing through the walls entraining the hot gas flow from the combustion chamber, these cooling-air ejection ducts being arranged on a circumference of the respective wall, and having exit openings positioned upstream of leading edges of nozzle guide vanes of the nozzle guide vane stator, to feed cooling air to the hot gas flow surfaces of the walls for film cooling, wherein at least some of the cooling-air ejection ducts are at least partly angled away from an axial direction relative to a circumferential direction by a certain angle $\alpha$ greater than 0° and up to and including 90°.

2. A platform cooling arrangement in accordance with claim 1, wherein the angle $\alpha$ of cooling-air ejection ducts in adjacent rows of cooling-air ejection ducts is different.

3. A platform cooling arrangement in accordance with claim 1, wherein the angle $\alpha$ of certain cooling-air ejection ducts in the same row is different.

4. A platform cooling arrangement in accordance with claim 1, wherein the angle $\alpha$ of certain cooling-air ejection ducts in any pattern of cooling-air ejection ducts is different.

5. A platform cooling arrangement in accordance with claim 4, wherein at least some of the cooling air ejection ducts have an angle $\alpha$ of 0°.

6. A platform cooling arrangement in accordance with claim 1, wherein the cooling-air ejection ducts are offset relative to each other in the same row.

7. A platform cooling arrangement in accordance with claim 1, wherein at least some of the cooling-air ejection ducts have at least one of: a variable cross-sectional shape and a variable size.

8. A platform cooling arrangement in accordance with claim 7, wherein at least some of the cooling-air ejection ducts in the same row differ from each other in at least one of: cross-sectional shape and size.

9. A platform cooling arrangement in accordance with claim 1, wherein one main gas-flow surface of the platforms is provided with a single cooling-air ejection duct.

10. A platform cooling arrangement in accordance with claim 1, wherein the angle $\alpha$ of cooling-air ejection ducts in adjacent rows of cooling-air ejection ducts is the same.

11. A platform cooling arrangement in accordance with claim 1, wherein the angle $\alpha$ of cooling-air ejection ducts in the same row is the same.

12. A platform cooling arrangement in accordance wit claim 1, wherein the angle $\alpha$ of cooling-air ejection ducts in any pattern of cooling-air ejection ducts is the same.

13. A platform cooling arrangement in accordance with claim 3, wherein at least some of the cooling air ejection ducts in the same row have an angle $\alpha$ of 0° and some have an angle of greater than 0°.

14. A platform cooling arrangement in accordance with claim 1, wherein the cooling-air ejection ducts are offset relative to an adjacent row.

15. A platform cooling arrangement in accordance with claim 7, wherein at least some of the cooling-air ejection ducts in a pattern differ from each other in at least one of: cross-sectional shape and size.

16. A platform cooling arrangement in accordance with claim 7, wherein at least some of the cooling-air ejection ducts in a row differ relative to cooling air ejection ducts in an adjacent row by at least one of: cross-sectional shape and size.

17. A platform cooling arrangement in accordance with claim 1, wherein each main gas-flow surface of the platforms is provided with a single cooling-air ejection duct.

18. A platform cooling arrangement in accordance with claim 1, wherein at least some of the cooling air ejection ducts have an angle $\alpha$ falling within a range (inclusive) of 25°-90°, in either circumferential direction away from the axial direction.

19. A platform cooling arrangement in accordance with claim 18, wherein at least some of the cooling air ejection ducts have an angle $\alpha$ falling within a range (inclusive) of 45°-90°, in either circumferential direction away from the axial direction.

20. A platform cooling arrangement in accordance with claim 1, wherein a desired Cooling Duct Cross Sectional Area is obtained when F≧0.0015 using the following equation:

Cooling Duct Cross Sectional Area≧*F*×(NGV Leading Edge Annulus Area)/(Number of NGVs)

where

NGV=Nozzle Guide Vane

NGV Leading Edge Annulus Area=π×((NGV Aerofoil Leading Edge Outer Radius)$^2$−(NGV Aerofoil Leading Edge Inner Radius)$^2$).

21. A platform cooling arrangement in accordance with claim 20, wherein F is within the range of 0.0015-0.010 inclusive.

22. A platform cooling arrangement in accordance with claim 21, wherein F is within the range of 0.002-0.006 inclusive.

23. A platform cooling arrangement in accordance with claim 22, wherein F is within the range of 0.003-0.005 inclusive.

24. A platform cooling arrangement for a nozzle guide vane stator of a gas turbine arranged downstream of a combustion chamber, with cooling-air ejection ducts passing through the walls entraining the hot gas flow from the combustion chamber, these cooling-air ejection ducts being arranged on a circumference of the respective wall, and having exit openings positioned upstream of leading edges of nozzle guide vanes of the nozzle guide vane stator, to feed cooling air to the hot gas flow surfaces of the walls for film cooling, wherein at least some of the cooling-air ejection ducts are at least partly angled away from an axial direction by a certain angle α greater than 0° and up to and including 90°, wherein a desired Cooling Duct Cross Sectional Area is obtained when F≧0.0015 using the following equation:

Cooling Duct Cross Sectional Area≧*F×(NGV Leading Edge Annulus Area)/(Number of NGVs)* where

NGV=Nozzle Guide Vane

NGV Leading Edge Annulus Area=π×((NGV Aerofoil Leading Edge Outer Radius)$^2$−(NGV Aerofoil Leading Edge Inner Radius)$^2$)

25. A platform cooling arrangement in accordance with claim 24, wherein F is within the range of 0.0015-0.010 inclusive.

26. A platform cooling arrangement in accordance with claim 25, wherein F is within the range of 0.002-0.006 inclusive.

27. A platform cooling arrangement in accordance with claim 26, wherein F is within the range of 0.003-0.005 inclusive.

* * * * *